US009512610B2

(12) United States Patent
Kinnunen

(10) Patent No.: US 9,512,610 B2
(45) Date of Patent: Dec. 6, 2016

(54) COLUMN SHOE

(71) Applicant: PEIKKO GROUP OY, Lahti (FI)

(72) Inventor: Jorma Kinnunen, Lahti (FI)

(73) Assignee: PEIKKO GROUP OY, Lahti (FI)

( * ) Notice: Subject to any disclaimer, the term of this patent is extended or adjusted under 35 U.S.C. 154(b) by 0 days.

(21) Appl. No.: 14/443,421

(22) PCT Filed: Dec. 4, 2013

(86) PCT No.: PCT/FI2013/051137

§ 371 (c)(1),
(2) Date: May 18, 2015

(87) PCT Pub. No.: WO2014/096523

PCT Pub. Date: Jun. 26, 2014

(65) Prior Publication Data

US 2015/0322665 A1 Nov. 12, 2015

(30) Foreign Application Priority Data

Dec. 18, 2012 (FI) ..... 20126323

(51) Int. Cl.
*E04B 1/21* (2006.01)
*E02D 5/72* (2006.01)
(Continued)

(52) U.S. Cl.
CPC . *E04B 1/21* (2013.01); *E02D 5/72* (2013.01); *E04B 1/215* (2013.01); *E04C 3/34* (2013.01); *E04C 5/163* (2013.01)

(58) Field of Classification Search
CPC ..... E04B 1/215; E04B 1/21; E02D 5/526; E02D 5/52; E02D 5/54; E02D 5/223; E02D 5/523; E04H 12/2253
See application file for complete search history.

(56) References Cited

U.S. PATENT DOCUMENTS 1,984,753 A * 12/1934 Moss ..... E04H 12/2261 52/292
2,724,261 A * 11/1955 Rensaa ..... E04B 1/0007 52/259
(Continued)

FOREIGN PATENT DOCUMENTS

EP 1 057 950 A2 12/2000
EP 1 531 213 A1 5/2005
(Continued)

OTHER PUBLICATIONS

Extended European search report and opinion for corresponding Application No. 13866472.7 dated Jul. 6, 2016 (7 pages).*
(Continued)

*Primary Examiner* — Rodney Mintz
(74) *Attorney, Agent, or Firm* — Oliff PLC

(57) ABSTRACT

A column shoe for securing building elements of concrete such as concrete columns to a base is provided. The column shoe includes a bolt housing, wherein the bolt housing includes a baseplate provided with a through bolt hole for an anchor bolt, and wherein the bolt housing includes an upper structure connected to the baseplate, and at least one attachment unit attached to the bolt housing for securing the column shoe and a building element together. The bolt housing is provided with at least one socket member for attaching an additional anchoring device such as a dowel or a bar to the column shoe in addition to at least one attachment unit and in addition to an anchor bolt.

14 Claims, 16 Drawing Sheets

Figure 1:
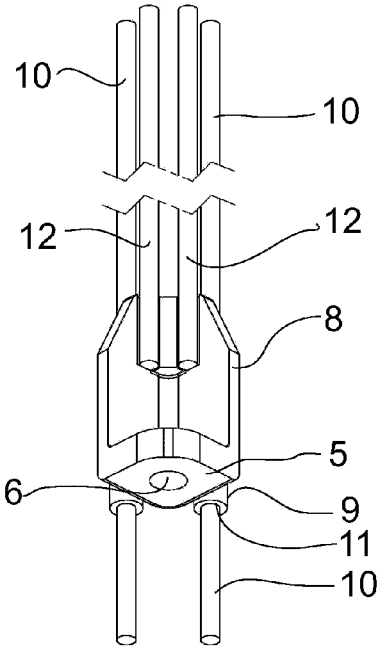

(51) Int. Cl.
*E04C 3/34* (2006.01)
*E04C 5/16* (2006.01)

(56) References Cited

U.S. PATENT DOCUMENTS 3,993,341 A 11/1976 Bentley
4,750,306 A * 6/1988 Granieri ..... E02D 27/50 52/251
4,781,006 A * 11/1988 Haynes ..... E04B 1/215 52/583.1
5,332,191 A * 7/1994 Nolan ..... B28B 7/0073 249/1
7,726,091 B2 6/2010 Frohlich et al.
8,336,267 B2 * 12/2012 Montague ..... E04B 1/24 52/295
8,844,237 B2 * 9/2014 Kapitza ..... E04H 12/12 52/583.1
2005/0016111 A1 * 1/2005 Knepp ..... E02D 27/42 52/633
2005/0102924 A1 5/2005 Frohlich et al.

FOREIGN PATENT DOCUMENTS

FI WO 2007074212 A1 * 7/2007 ..... E02D 5/226
FI WO 2012056100 A1 * 5/2012 ..... E04B 1/215
GB WO 9802625 A1 * 1/1998 ..... E04B 1/215
WO 03074821 A1 9/2003
WO 2012056100 A1 5/2012

OTHER PUBLICATIONS

Mar. 26, 2014 Search Report issued in International Patent Application No. PCT/FI2013/051137.
Oct. 10, 2013 Office Action issued in Finnish Patent Application No. 20126323.

* cited by examiner

COLUMN SHOE

FIELD OF THE INVENTION

The invention relates to a column shoe as defined in the preamble of independent claim 1.

The invention relates to column shoes which are used in lower ends of building elements of concrete, preferably precast building elements of concrete, such as in lower end corners of concrete columns or corresponding concrete element columns and/or in lower end edges of concrete columns or corresponding concrete element columns for securing the building element to bolts projecting from a base structure. A column shoe according to the invention may however also be used for securing wall elements of concrete to bolts projecting from a base structure. A column shoe according to the invention may however also be used for securing walls of concrete and beams of concrete and slabs of concrete to bolts projecting from a base structure.

Publication WO 2012/056100 presents a column shoe for securing steel concrete columns to a base. The column shoe comprises a bolt housing, which comprises a baseplate provided with a bolt hole, and a sideplate, and attachment units fixedly connected to the bolt housing for securing the column shoe and the steel concrete column together.

Objective of the Invention

The object of the invention is to provide a column shoe that provides for increased column shoe and connection shear force resistance and for increased column shoe and connection tension force resistance.

Short Description of the Invention

The column shoe is characterized by the definitions of independent claim 1.

Preferred embodiments of the column shoe are defined in the dependent claims.

In the column shoe the bolt housing is provided with at least one socket member for attaching an additional anchoring means such as a dowel or a bar to the column shoe in addition to at least one attachment unit and in addition to an anchor bolt.

The additional anchoring means, when fastened to a column shoe, increases column shoe and connection shear force resistance and increases column shoe and connection tension force resistance.

The additional anchoring means, when fastened to a column shoe, increases the seismic resistance.

The additional anchoring means, when fastened to a column shoe, increases the pull-out capacity of the column shoe in the horizontal direction.

The additional anchoring means may be in the form of a main bond, a reinforcement bar, or a dowel bar.

The additional anchoring means may be installed or attached to the bolt housing after casting of the column shoe into a building element of concrete. No modifications to the formwork for casting the concrete unit is therefore necessarily needed in order to provide a bolt housing with additional anchoring means.

The invention relates also to the use of a column shoe for lifting a building element of concrete having at least one column shoe attached to the building element of concrete by attaching a lifting member to a socket member of the column shoe attached to the building element of concrete and by lifting the building element of concrete by lifting from the lifting member.

LIST OF FIGURES

Figure 2:
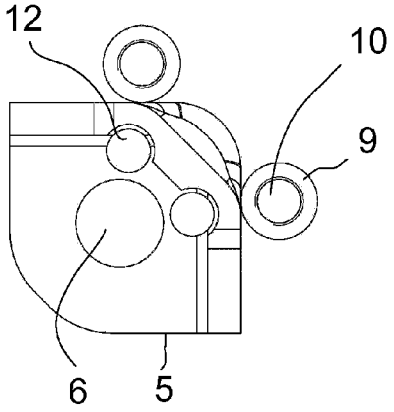
Figure 3:
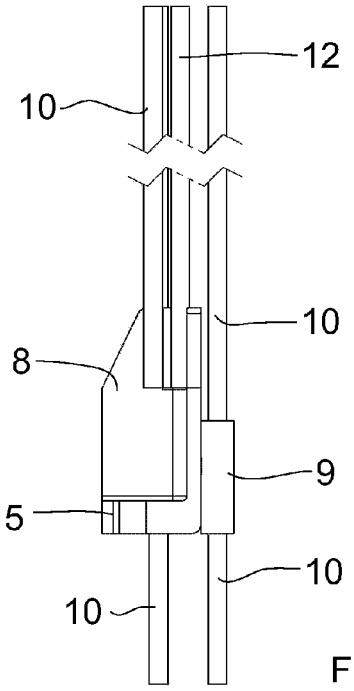
Figure 4:
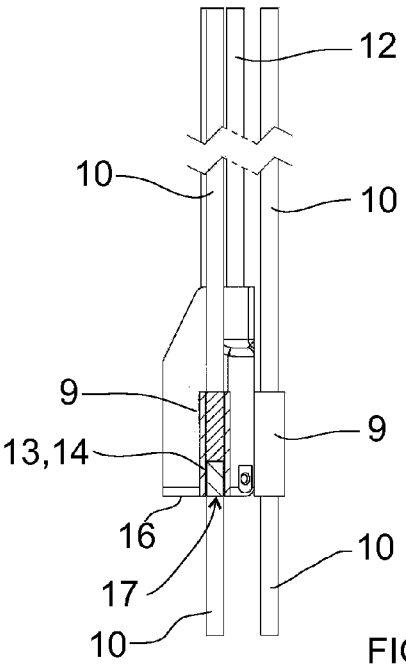
Figure 5:
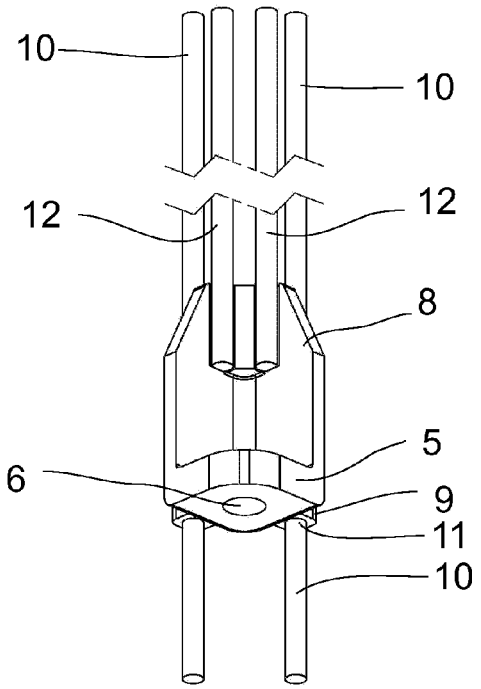
Figure 6:
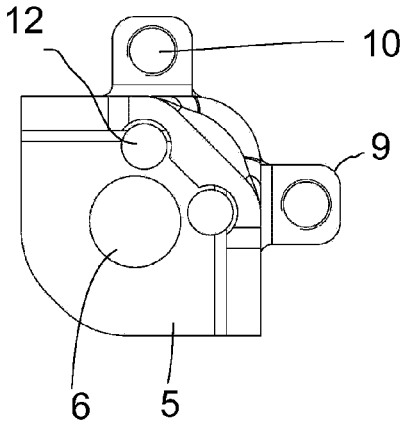
Figure 7:
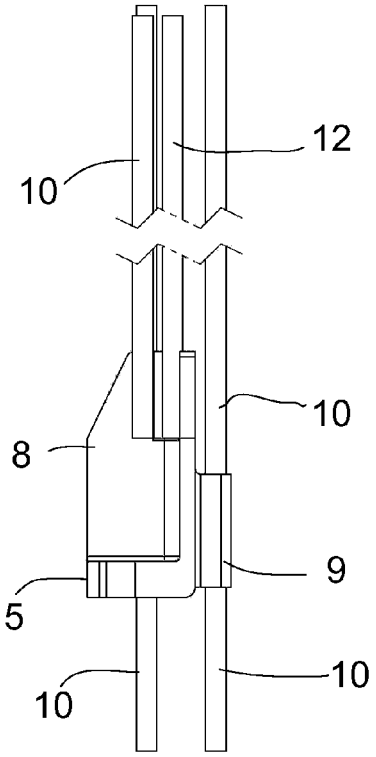
Figure 8:
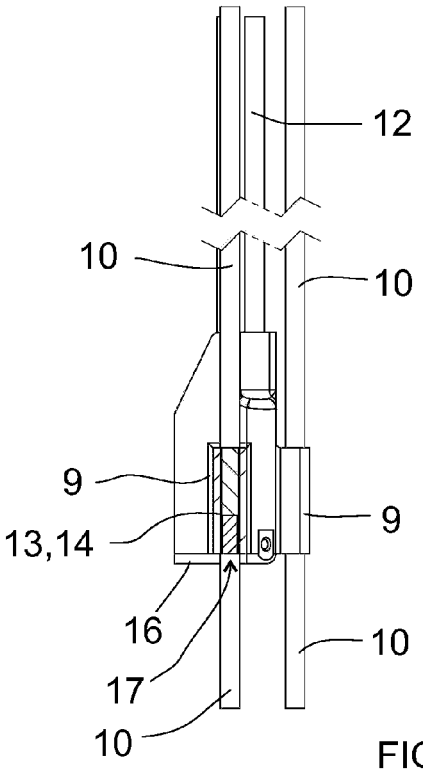
Figure 9:
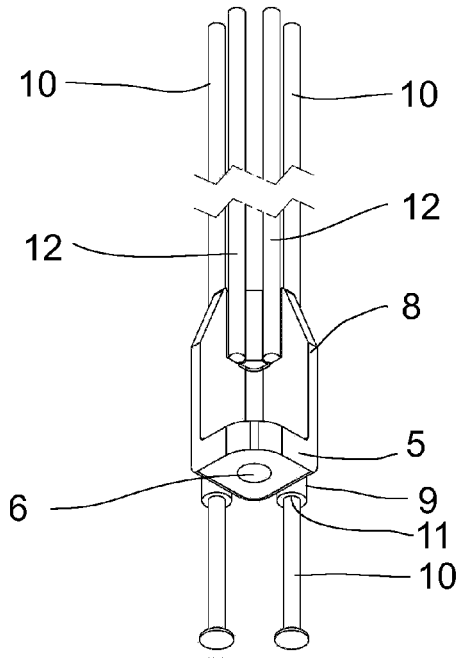
Figure 10:
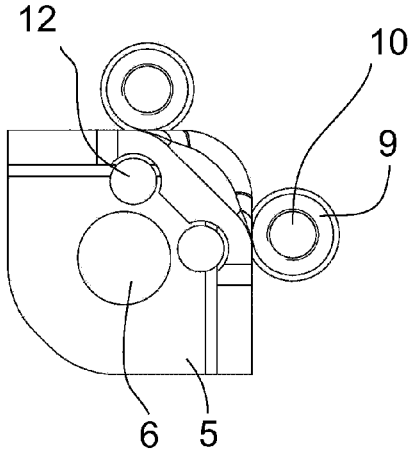
Figure 11:
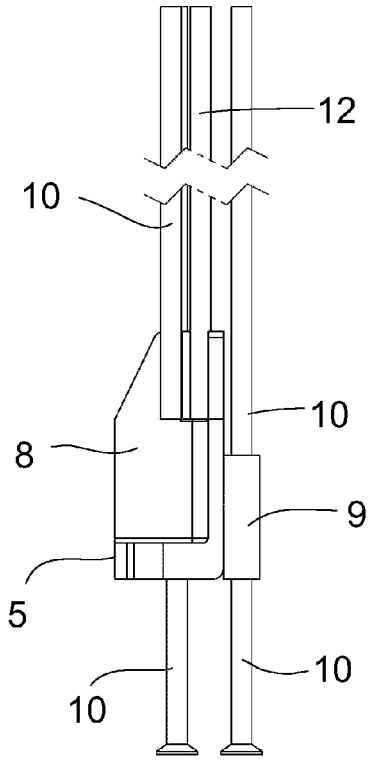
Figure 12:
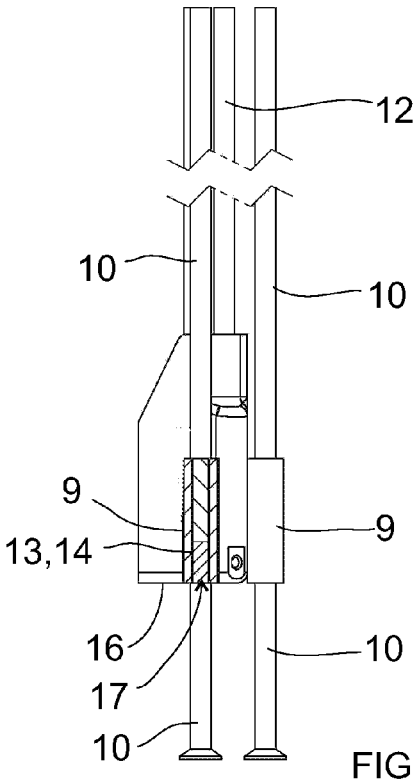
Figure 13:
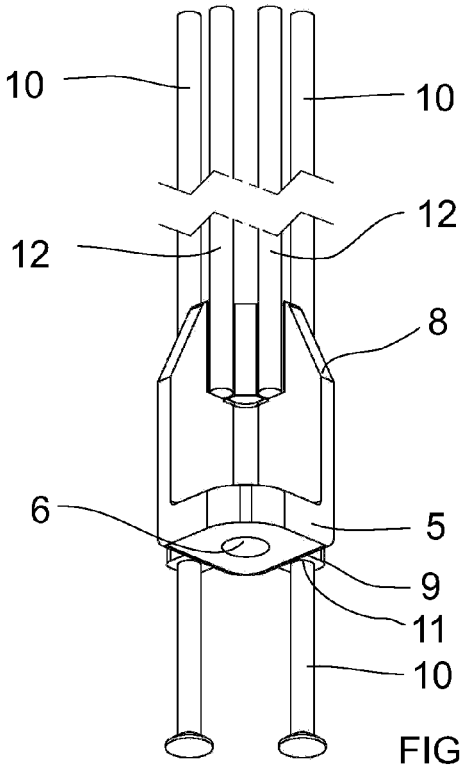
Figure 14:
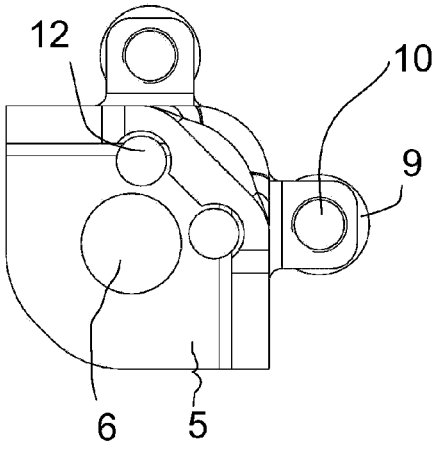
Figure 15:
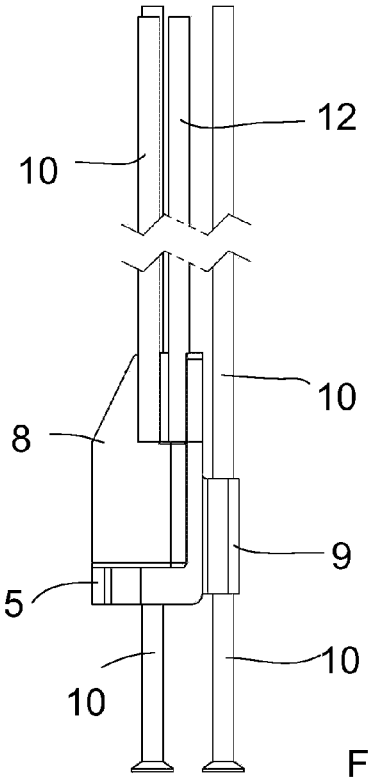
Figure 16:
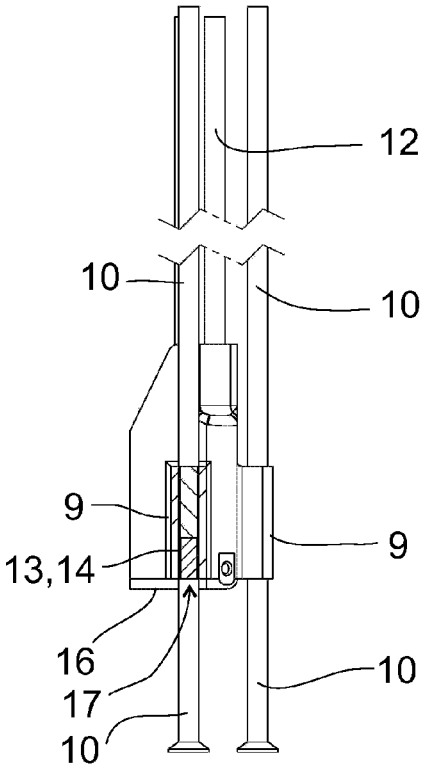
Figure 17:
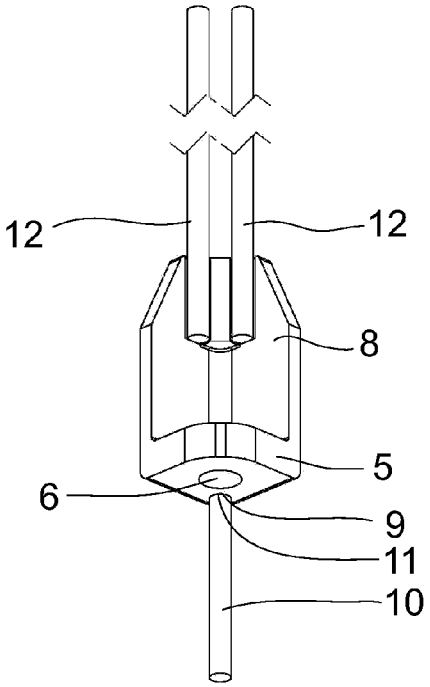
Figure 18:
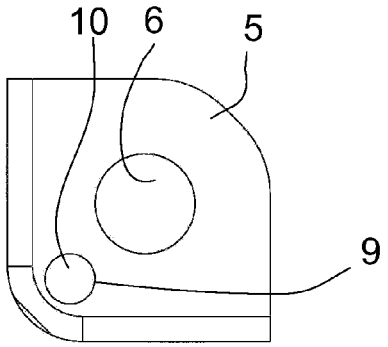
Figure 19:
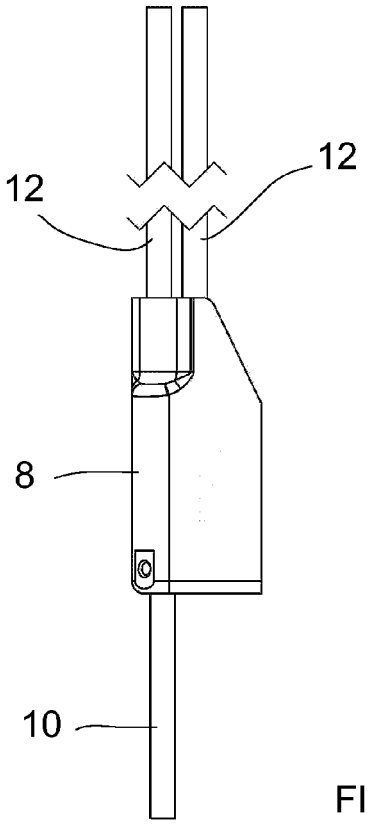
Figure 20:
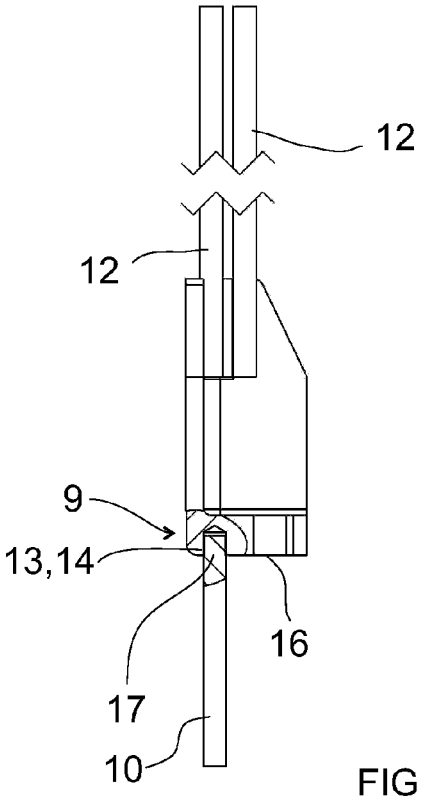
Figure 21:
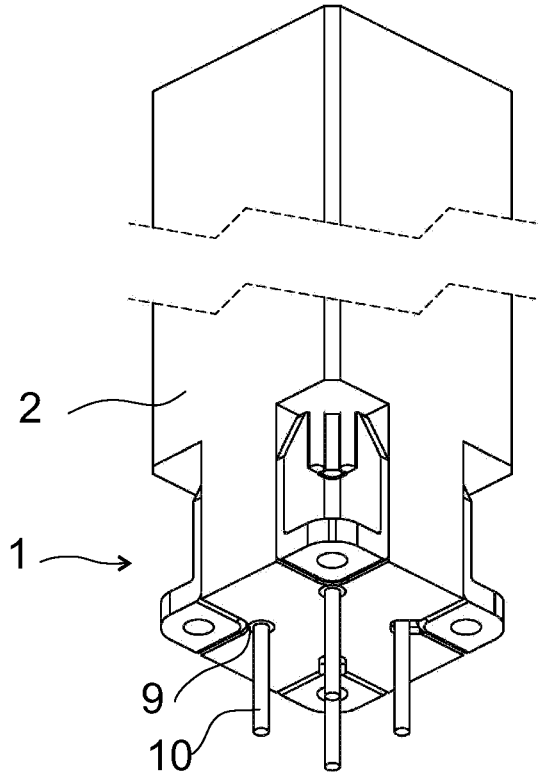
Figure 22:
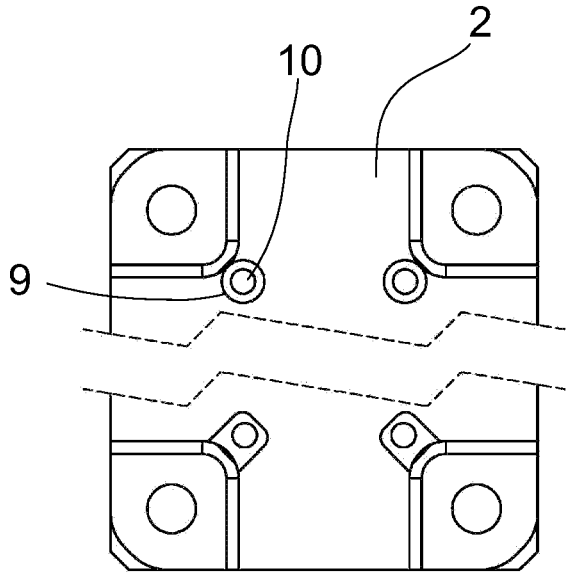
Figure 23:
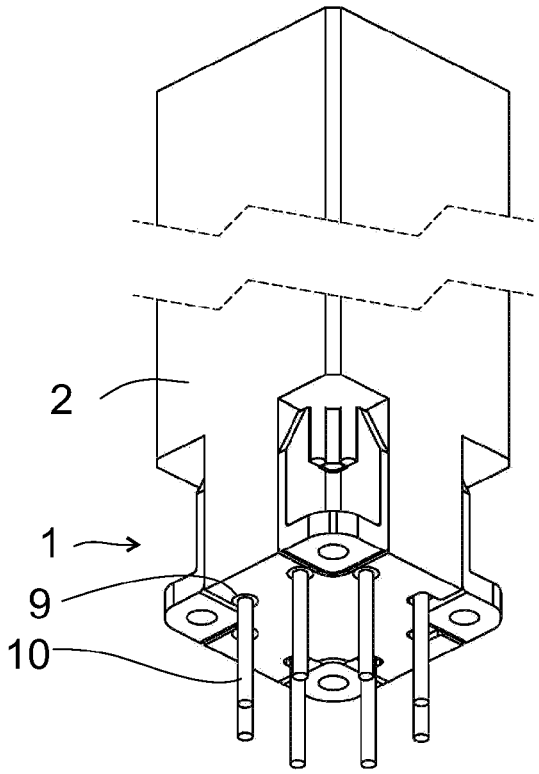
Figure 24:
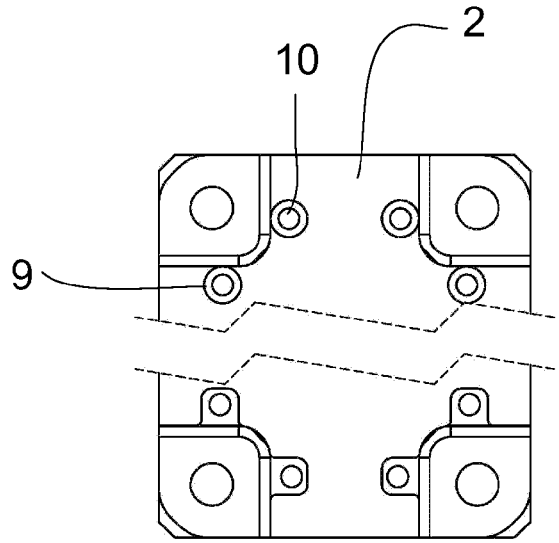
Figure 25:
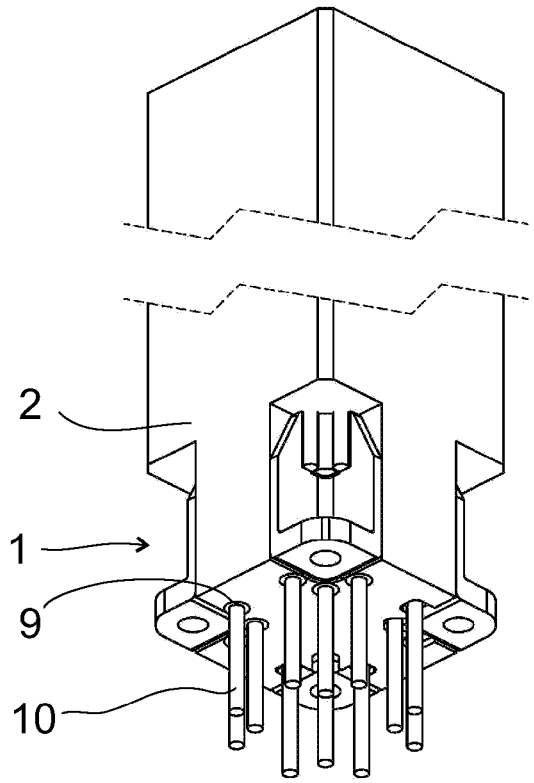
Figure 26:
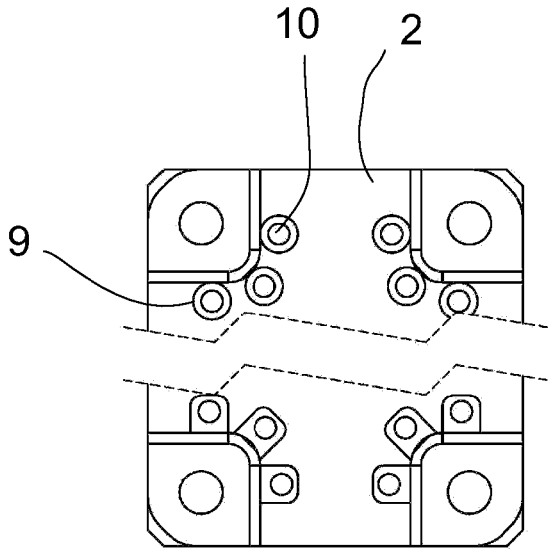
Figure 27:
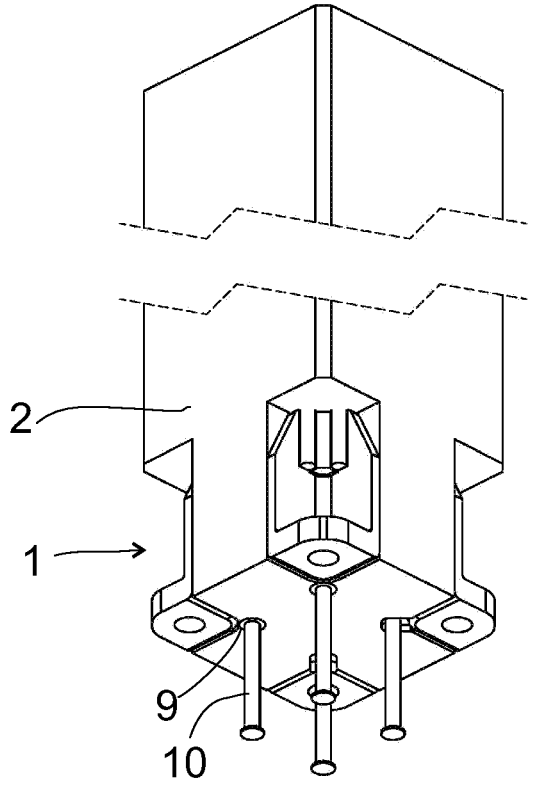
Figure 28:
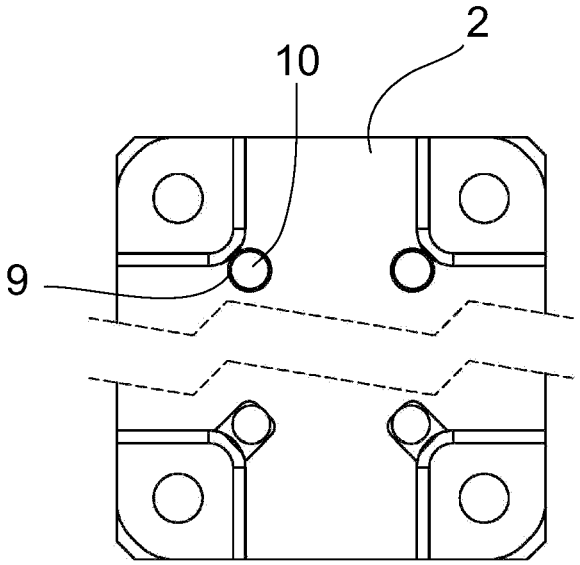
Figure 29:
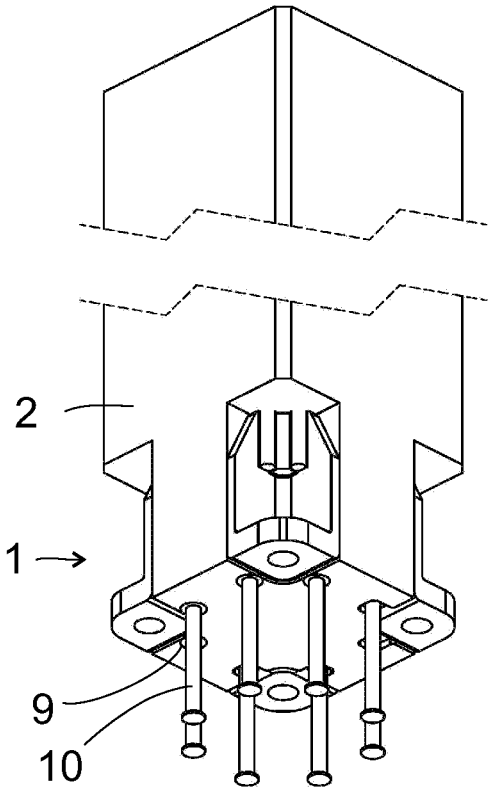
Figure 30:
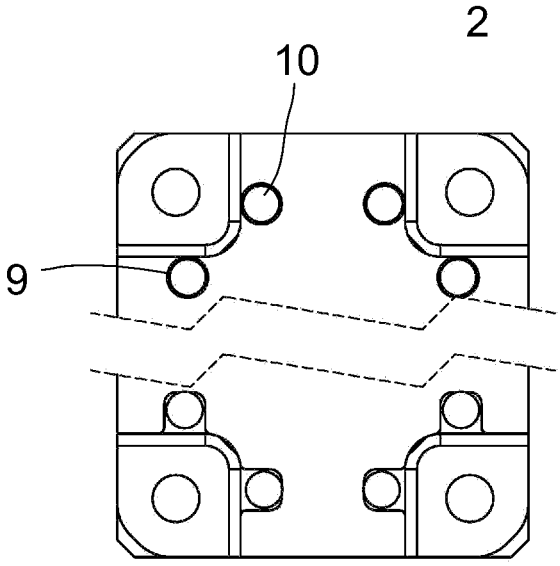
Figure 31:
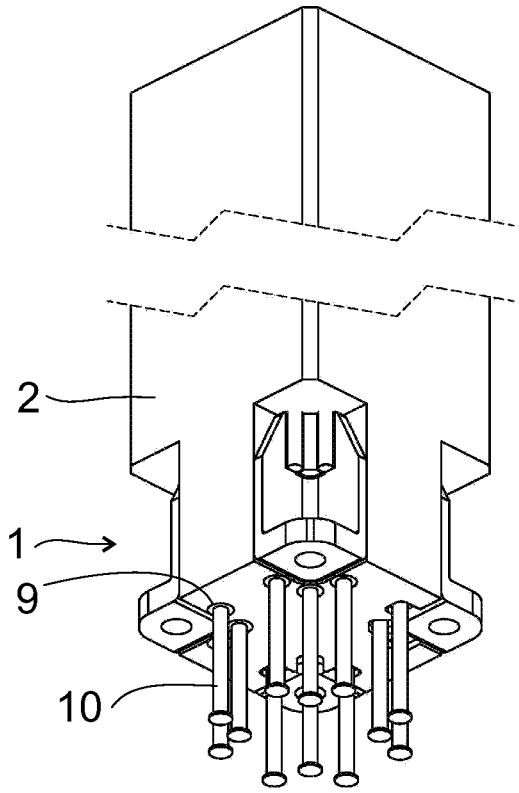
Figure 32:
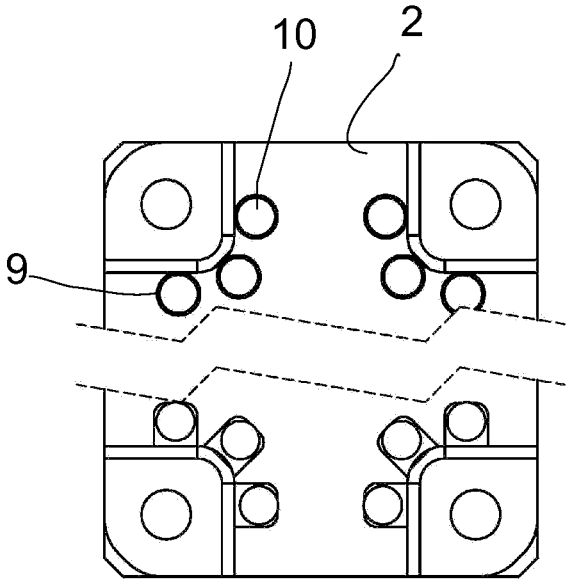
Figure 33:
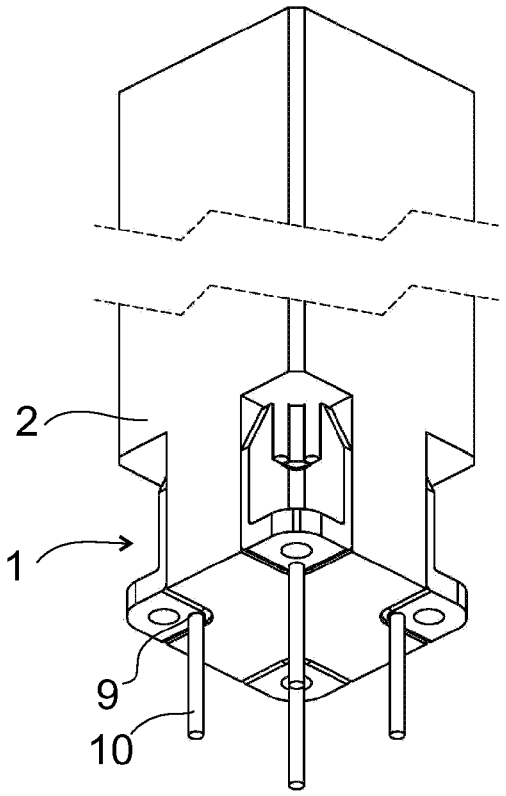
Figure 34:
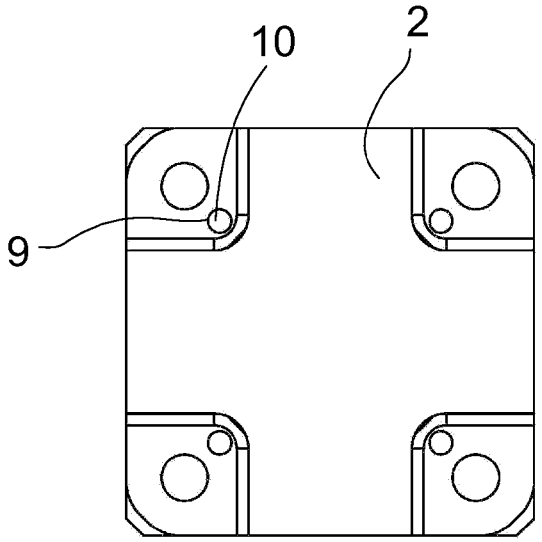
Figure 35:
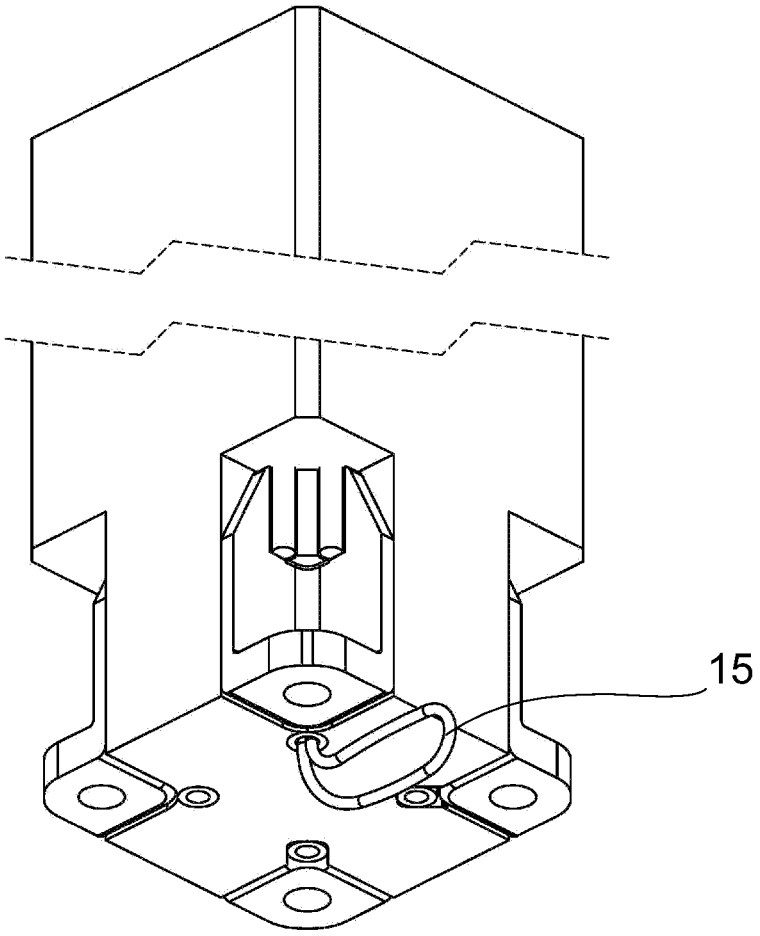
Figure 36:
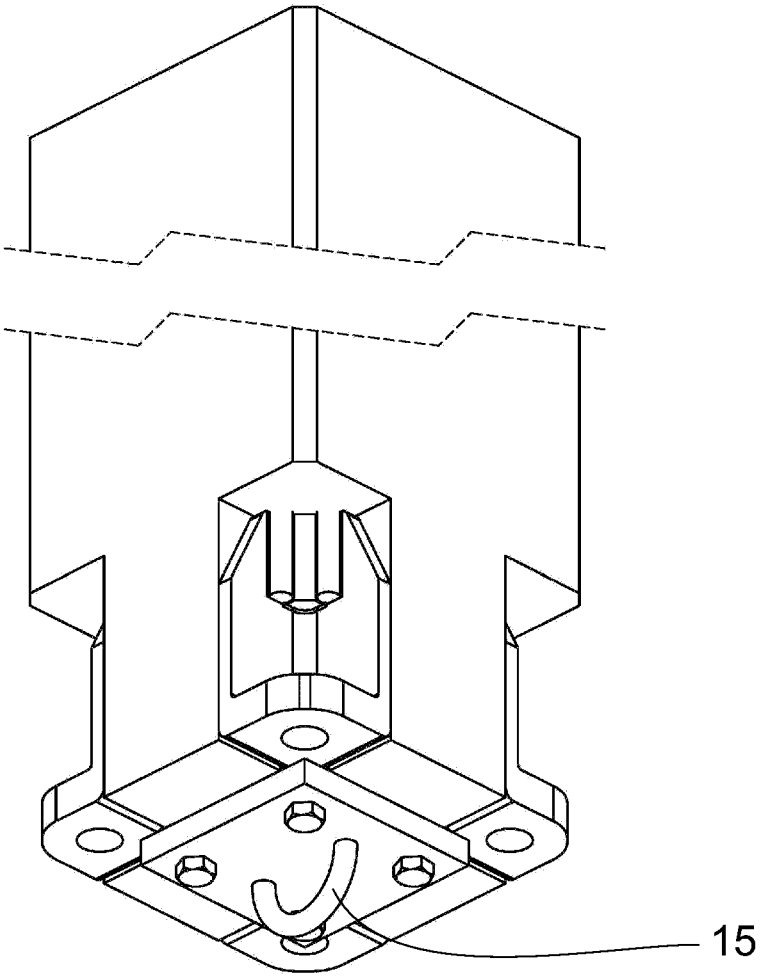
Figure 37:
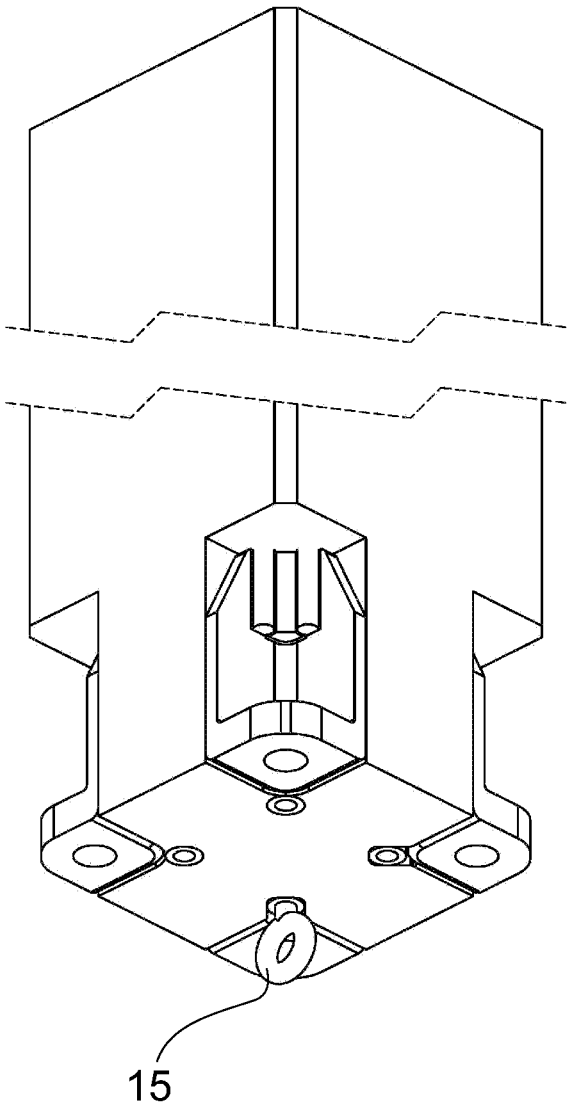
Figure 38:
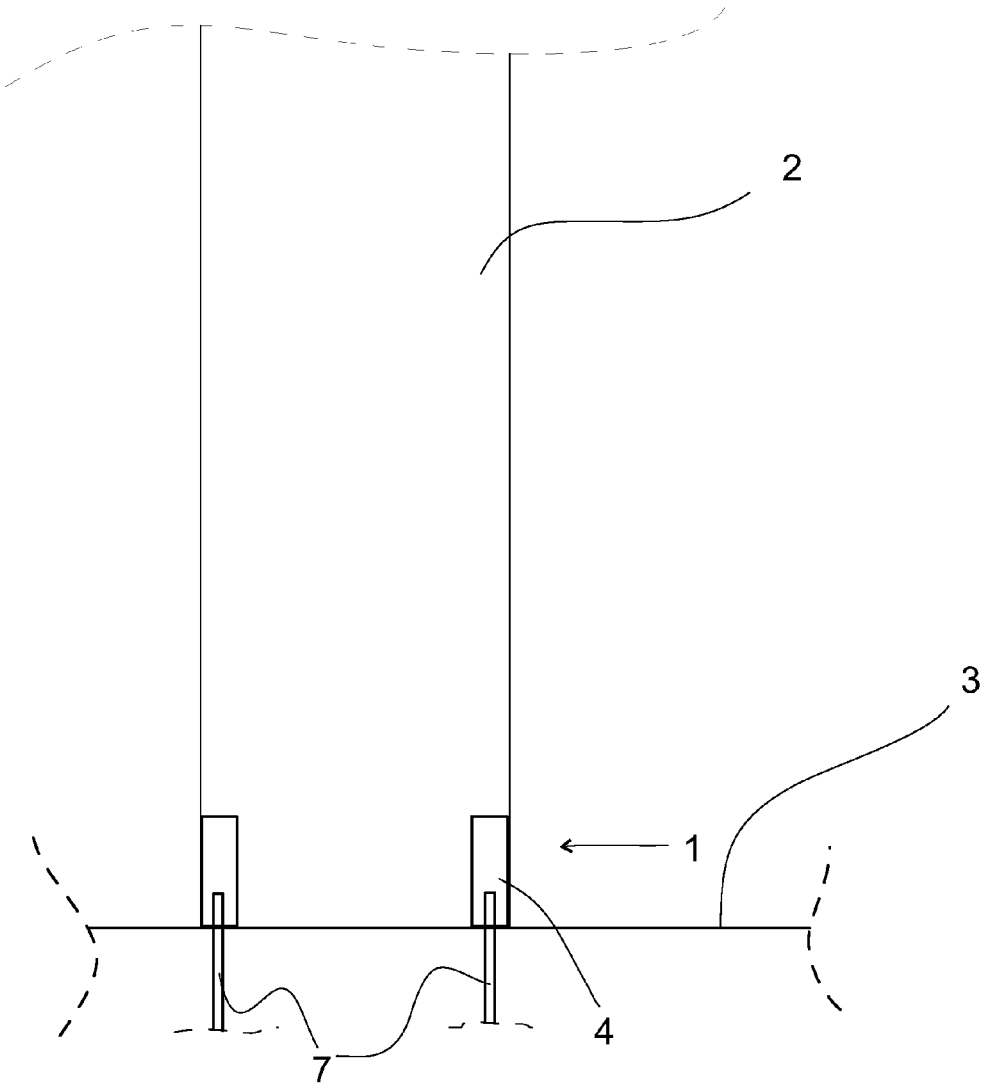

In the following the invention will described in more detail by referring to the figures, of which FIG. 1 shows a column shoe according to a first embodiment, FIG. 2 shows the column shoe shown in FIG. 1 from above, FIG. 3 shows the column shoe shown in FIG. 1 from one side FIG. 4 shows the column shoe shown in FIG. 1 in partly cut view, FIG. 5 shows a column shoe according to a second embodiment, FIG. 6 shows the column shoe shown in FIG. 5 from above, FIG. 7 shows the column shoe shown in FIG. 5 from one side FIG. 8 shows the column shoe shown in FIG. 5 in partly cut view, FIG. 9 shows a column shoe according to a third embodiment, FIG. 10 shows the column shoe shown in FIG. 9 from above, FIG. 11 shows the column shoe shown in FIG. 9 from one side FIG. 12 shows the column shoe shown in FIG. 9 in partly cut view, FIG. 13 shows a column shoe according to a fourth embodiment, FIG. 14 shows the column shoe shown in FIG. 13 from above, FIG. 15 shows the column shoe shown in FIG. 13 from one side FIG. 16 shows the column shoe shown in FIG. 13 in partly cut view, FIG. 17 shows a column shoe according to a fifth embodiment, FIG. 18 shows the column shoe shown in FIG. 17 from above, FIG. 19 shows the column shoe shown in FIG. 17 from one side FIG. 20 shows the column shoe shown in FIG. 17 in partly cut view, FIG. 21 shows a concrete column provided with four column shoes according to one embodiment, FIG. 22 shows the concrete column shown in FIG. 21 as seen from below, FIG. 23 shows a concrete column provided with four column shoes according to the first embodiment shown in FIGS. 1 to 4, FIG. 24 shows the concrete column shown in FIG. 23 as seen from below, FIG. 25 shows a concrete column provided with four column shoes according to another embodiment, FIG. 26 shows the concrete column shown in FIG. 25 as seen from below, FIG. 27 shows a concrete column provided with four column shoes according to yet another embodiment, FIG. 28 shows the concrete column shown in FIG. 27 as seen from below, FIG. 29 shows a concrete column provided with four column shoes according to the third embodiment shown in FIGS. 9 to 12, FIG. 30 shows the concrete column shown in FIG. 29 as seen from below, FIG. 31 shows a concrete column provided with four column shoes according to still another embodiment, FIG. 32 shows the concrete column shown in FIG. 31 as seen from below, FIG. 33 shows a concrete column provided with four column shoes according to the fifth embodiment shown in FIGS. 17 to 20, FIG. 34 shows the concrete column shown in FIG. 33 as seen from below, FIG. 35 shows a concrete column provided with four column shoes according to another embodiment of the column shoe, where a lifting loop is fastened to one column shoe, FIG. 36 shows a concrete column provided with four column shoes according to another embodiment of the column shoe, where a lifting device is fastened to the four column shoes, FIG. 37 shows a concrete column provided with four column shoes according to another embodiment of the column shoe where a lifting ring is fastened to one column shoe, and FIG. 38 shows a concrete column attached to a base by means of column shoes.

DETAILED DESCRIPTION OF THE INVENTION

FIGS. 1 to 20 show five different embodiments of a column shoe 1 for securing building elements of concrete such as concrete columns to a base 3 such as a foundation of a building or a corresponding load-bearing structure. The building element of concrete is preferably in the form of a precast building element of concrete such as a precast concrete column, which means that the building element of concrete is manufactured at a location different from the construction site where the building element is used in a building. The building element can also be in the form of a wall element of concrete, a precast wall element of concrete, a beam of concrete, a precast beam of concrete, a slab of concrete, or a precast slab of concrete.

FIGS. 21 to 34 show seven different concrete columns 2 each provided with four column shoes 1 so that each lower corner of each concrete column 2 is provided with a column shoe 1.

The column shoe 1 comprises a bolt housing 4 that comprises a baseplate 5 provided with a through bolt hole 6 for an anchor bolt 7 which is partly arranged in the baseplate 5 so that the anchor bolt 7 projects from the base 3. The anchor bolt 7 may be provided with treads (not shown) for nuts (not shown) in order to secure the bolt housing 4 of the column shoe 1 to the base 3.

The baseplate 5 comprises a bottom surface 16 that also forms an end surface of the bolt housing 4, by an opening 17 of the hole 11 is located at a level of the bottom surface 16 of the baseplate 5 plate.

The bolt housing 4 comprises additionally an upper structure 8 connected to the baseplate 5.

The column shoe 1 comprises additionally at least one attachment unit 12 attached to the bolt housing 4 for securing the column shoe 1 and the concrete column 2 together. A such attachment unit 12 may be fixedly or releasable attached to the bolt housing 4.

The bolt housing 4 is provided with at least one socket member 9 for attaching an additional anchoring means 10 such as a dowel, as is shown in FIGS. 9 to 16 and 27 to 32, or a bar, as is shown in FIGS. 1 to 8 and 17 to 26 and 33 to 34, to the column shoe 1 in addition to at least one attachment unit 12 and in addition to an anchor bolt 7.

A purpose of the attachment unit 12 is to transfer loads between the building element of concrete, into which the column shoe is to be at least partly cast, and the base 3. Such loads may include any of the following: shear force, tension, bending, torque and pressure.

The number of socket members 9 per column shoe 1 may vary. The figures show column shoes 1 having one, two, or three socket members 9.

The column shoe 1 comprises preferably, but not necessarily, a socket member 9 comprising a hole 11 for at least partly receiving an additional anchoring means 10.

The column shoe 1 comprises, as shown in FIGS. 1 to 16, at least one a socket member 9 comprising a hole 11 in the form of a cylindrical through hole for at least partly receiving an additional anchoring means 10.

The column shoe 1 may, as shown in FIGS. 17 to 20, comprise at least one a socket member 9 comprising a hole 11 in the form of a cylindrical blind hole for at least partly receiving an additional anchoring means 10.

The hole 11 of the socket member 9 is provided with an inner threading 13 for cooperation with an outer threading 14 of at least one additional anchoring means 10.

The inner threading 13 extends over the whole length of the hole 11. In practice this means that if the socket member 9 comprises a hole 11 in the form of a cylindrical through hole having an inner threading 13 extending over the whole length of the cylindrical through hole, one additional anchoring means 10 can be fastened at both ends of the cylindrical through hole. For example in the embodiments shown in FIGS. 1 to 16, two additional anchoring means 10 are attached to each socket member 9 so that one additional anchoring means 10 is attached using the inner threading 13 of the cylindrical through hole at one end of the cylindrical through hole and so that another additional anchoring means 10 is attached using the inner threading 13 of the cylindrical through hole at the opposite end of the cylindrical through hole.

If the column shoe 1 comprises a socket member 9 comprising a hole 11, the hole 11 is preferably, but not necessarily, a cylindrical hole, such as a through or blind hole, having a first central axis that is parallel with a second central axis of a cylindrical through bolt hole 6 in the baseplate 5 of the bolt housing 4, provided that the through bolt hole 6 in the baseplate 5 of the bolt housing 4 is in the form of a cylindrical through bolt hole 6

Instead of or in addition to the bolt housing 4 only being provided with at least one socket member 9 for attaching an additional anchoring means 10 to the bolt housing 4, the column shoe 1 may be provided with an additional anchoring means 10. Such additional anchoring means 10 may be arranged at least partly in a socket member 9 so that the additional anchoring means 10 is fastened to the bolt housing 4 by means of a positive connection between the socket member 9 and the additional anchoring means 10. It is also possible that the column shoe 1 is provided with an additional anchoring means 10 having an outer threading 14 and that the socket member 9 comprising a hole 11 provided an inner threading 13 for cooperation with the outer threading 14 of the additional anchoring means 10, whereby the additional anchoring means 10 is arranged at least partly in the hole 11 of the socket member 9 so that the additional anchoring means 10 is fastened to the bolt housing 4 by means of the inner threading 13 in the hole 11 of the socket member 9 and the outer threading 14 of the additional anchoring means 10.

The bolt housing 4 may be a casted one-piece structure or a structure formed by welding together several sub-structures such as a baseplate 5 and an upper structure 8.

The column shoe 1 may comprise a socket member 9 that is an integrated part of at least one of the upper structure 8 of the bolt housing 4 and the baseplate 5 of the bolt housing 4. Especially if the bolt housing 4 is a casted one-piece structure it may be of an advantage to provide the bolt housing 4 with integrated casted socket members 9 in connection with the casting of the bolt housing 4.

The column shoe 1 may comprise a socket member 9 that is an external structure of the bolt housing 4 and that is fixedly of releasable attached to at least one of the upper structure 8 of the bolt housing 4 and the baseplate 5 of the bolt housing 4.

The column shoe 1 may comprise a socket member 9 that is at least partly formed in at least one of the upper structure 8 of the bolt housing 4 and the baseplate 5 of the bolt housing 4.

The column shoe 1 may comprise a socket member 9 that is formed fully within the baseplate 5 of the bolt housing 4 of the bolt housing 4 as is the case in the fifth embodiment of the column shoe 1 shown in FIGS. 17 to 20.

The column shoe 1 may comprise a socket member 9 for attaching an additional anchoring means 10 in the form of a main bond. It is also possible that the column shoe 1 comprises a socket member 9 for attaching an additional anchoring means 10 in the form of a main bond and an additional anchoring means 10 in the form of a main bond fastened to said socket member 9 for attaching an additional anchoring means 10 in the form of a main bond.

The column shoe 1 may comprise a socket member 9 for attaching an additional anchoring means 10 in the form of a reinforcement bar. It is also possible that the column shoe 1 comprises a socket member 9 for attaching an additional anchoring means 10 in the form of a reinforcement bar and an additional anchoring means 10 in the form of a reinforcement bar fastened to said socket member 9 for attaching an additional anchoring means 10 in the form of a reinforcement bar.

The column shoe 1 may comprise a socket member 9 for attaching an additional anchoring means 10 in the form of a dowel bar. It is also possible that the column shoe 1 comprises a socket member 9 for attaching an additional anchoring means 10 in the form of a dowel bar and an additional anchoring means 10 in the form of a dowel bar fastened to said socket member 9 for attaching an additional anchoring means 10 in the form of a dowel bar.

A column shoe 1 as described here and that is fastened to a building element of concrete may be used lifting the building element of concrete by attaching a lifting member 15 to the socket member 9 of the column shoe 1 as is shown in FIGS. 35 to 37 and by lifting the building element of concrete from the lifting member 15.

It is apparent to a person skilled in the art that as technology advances, the basic idea of the invention can be implemented in various ways. The invention and its embodiments are therefore not restricted to the above examples, but they may vary within the scope of the claims.

The invention claimed is:

1. A column shoe for securing building elements of concrete comprising:

a bolt housing, wherein the bolt housing comprises a baseplate provided with a through bolt hole for an anchor bolt, and wherein the bolt housing comprises an upper structure connected to the baseplate, and at least one attachment unit attached to the bolt housing for securing the column shoe and one of said building elements together, wherein the bolt housing being provided with at least one socket member for attaching at least one additional anchoring means to the column shoe in addition to the at least one attachment unit and in addition to the anchor bolt, and wherein the socket member comprising a hole, the hole being in the form of a cylindrical through hole for at least partly receiving the at least one additional anchoring means, wherein the hole of the socket member being provided with an inner threading for co-operation with an outer threading of the at least one additional anchoring means, and wherein the inner threading extends over the whole length of the hole of the socket member and the socket member being configured to receive one of the at least one additional anchoring means at a first end of the hole and another one of the at least one additional anchoring means at a second end of the hole opposite the first end of the hole.

2. The column shoe according to claim 1 wherein the through bolt hole in the baseplate of the bolt housing is a cylindrical through bolt hole, and wherein the cylindrical through hole of the socket member having a first central axis that is parallel with a second central axis of the cylindrical through bolt hole in the baseplate of the bolt housing.

3. The column shoe according to claim 1, wherein the baseplate comprises a bottom surface that also forms an end surface of the bolt housing, an opening of the hole of the socket member is located at a level of the bottom surface of the baseplate plate.

4. The column shoe according to claim 1, wherein the socket member is an integrated part of at least one of the baseplate and the upper structure of the bolt housing.

5. The column shoe according to claim 1, wherein the socket member is an external structure of the bolt housing and is fixedly or releasable attached to at least one of the upper structure of the bolt housing and the baseplate of the bolt housing.

6. The column shoe according to claim 1, wherein the socket member is at least partly formed at least one of the baseplate and the upper structure of the bolt housing.

7. The column shoe according to claim 1, wherein the socket member is formed fully within the baseplate of the bolt housing.

8. The column shoe according to claim 1, wherein the column shoe being provided with the at least one additional anchoring means, the at least one additional anchoring means having the outer threading, and the at least one additional anchoring means being arranged at least partly in a socket member so that the at least one additional anchoring means is fastened to the bolt housing by means of the inner threading of the socket member and the outer threading of the at least one additional anchoring means.

9. The column shoe according to claim 1, wherein the at least one attachment unit is attached to the upper structure of the bolt housing.

10. The column shoe according to claim 1, wherein the column shoe being provided with the at least one additional anchoring means, the at least one additional anchoring means being arranged at least partly in the socket member so that the at least one additional anchoring means is fastened to the bolt housing by means of a positive connection between the socket member and the at least one additional anchoring means.

11. The column shoe according to claim 10, wherein the at least one additional anchoring means is in the form of a main bond.

12. The column shoe according to claim 10, wherein the at least one additional anchoring means is in the form of a reinforcement bar.

13. The column shoe according to claim 10, wherein the at least one additional anchoring means is in the form of a dowel bar.

14. A method comprising:

lifting a concrete column having at least one said column shoe according to claim 1 attached to the concrete column by attaching a lifting member to the socket member of the at least one column shoe attached to the concrete column and by lifting the concrete column by lifting from the lifting member.

* * * * *